US006464206B1

(12) United States Patent
Alten

(10) Patent No.: US 6,464,206 B1
(45) Date of Patent: Oct. 15, 2002

(54) JACK WITH AN INSERTION TRUNNION

(75) Inventor: Ferdinand Alten, Mandern (DE)

(73) Assignee: Krupp Bilstein GmbH, Ennepetal (DE)

( * ) Notice: Subject to any disclaimer, the term of this patent is extended or adjusted under 35 U.S.C. 154(b) by 0 days.

(21) Appl. No.: 09/694,754

(22) Filed: Oct. 23, 2000

(30) Foreign Application Priority Data

Nov. 9, 1999 (DE) ..... 199 53 817

(51) Int. Cl.[7] ..... B66F 3/36
(52) U.S. Cl. ..... 254/126
(58) Field of Search ..... 254/100, 133, 254/134, 126, 122, DIG. 4

(56) References Cited

U.S. PATENT DOCUMENTS 2,259,789 A * 10/1941 Akins ..... 254/100
2,590,970 A * 4/1952 Jensen ..... 254/100
2,945,662 A * 7/1960 Jennings ..... 254/100
4,558,848 A * 12/1985 Rutter ..... 254/100

* cited by examiner

*Primary Examiner*—Robert C. Watson
(74) *Attorney, Agent, or Firm*—Max Fogiel

(57) ABSTRACT

In the case of a jack with a supporting element, at which the insertion trunnion (11), which can be folded vertically over a joint (12), is mounted with a stop (16) limiting the depth of insertion, in order to construct the stop (15) and fix it securely and reliably in position in a simple manner and so as to have little weight, it is a part of an intermediate layer, which is disposed in the region of the joint (12) between the insertion trunnion (11) and the supporting element.

3 Claims, 1 Drawing Sheet

5
7
3
4
1
2
9
13
21
14
17
6
15
19
20
16
11
12
18
10
8

JACK WITH AN INSERTION TRUNNION

BACKGROUND OF THE INVENTION

The invention relates to a jack with a supporting element at which an insertion trunnion which can be folded vertically, is mounted.

Jacks with insertion trunnions are used to lift vehicles, which have preferably cylindrical accommodating openings in region of the door sill or underneath the floor. To lift the vehicle, preferably when changing a wheel, an insertion trunnion, disposed at the supporting element, is then pushed into the insertion opening at the vehicle. With that, a non-positive and positive connection is established between the jack and the vehicle. It is known that the insertion trunnion may be provided with a stop, in order to be able to maintain an accurate depth of insertion of the insertion trunnion in the insertion opening. The construction of the stops at the insertion trunnion is realized in different ways.

According to the DE 1 216 508 C, the thickened end of the insertion trunnion serves as stop. This requires a high expenditure for processing and, moreover, leads to a higher weight, which is undesirable for jacks. In the case of the construction of an insertion trunnion of the DE 38 16 054, a part, accommodating the insertion trunnion, serves as stop. This construction is also associated with high manufacturing expenses and a greater weight. In the DE 27 07 016 A1, a pushed-on sleeve serves as a stop for achieving the desired depth of insertion of the insertion trunnion. It is a disadvantage here that this sleeve can easily be lost. If this is to be excluded, an additional working operation and additional material for connecting the pushed-on sleeve with the insertion trunnion are required.

SUMMARY OF THE INVENTION

It is an object of the invention to provide a stop at the insertion trunnion for a generic jack, which has only a low weight and can be fixed in position easily, safely and reliably.

The advantages, achieved with the invention, consist especially therein that the stop, limiting the depth of insertion of the insertion trunnion, is not only light and connected with the insertion trunnion easily and safely, but also, due to its construction as an intermediate layer between the trunnion and the supporting element, advantageously assumes the task of ensuring a permanently smooth operation of the folding movement between the insertion trunnion and the supporting element and, furthermore, reduces the wear between the insertion trunnion and the supporting element.

BRIEF DESCRIPTION OF THE DRAWING

An example of the invention is described in greater detail in the following and shown in the drawing, in which.

DESCRIPTION OF THE PREFERRED EMBODIMENTS

Figures 1, 2:
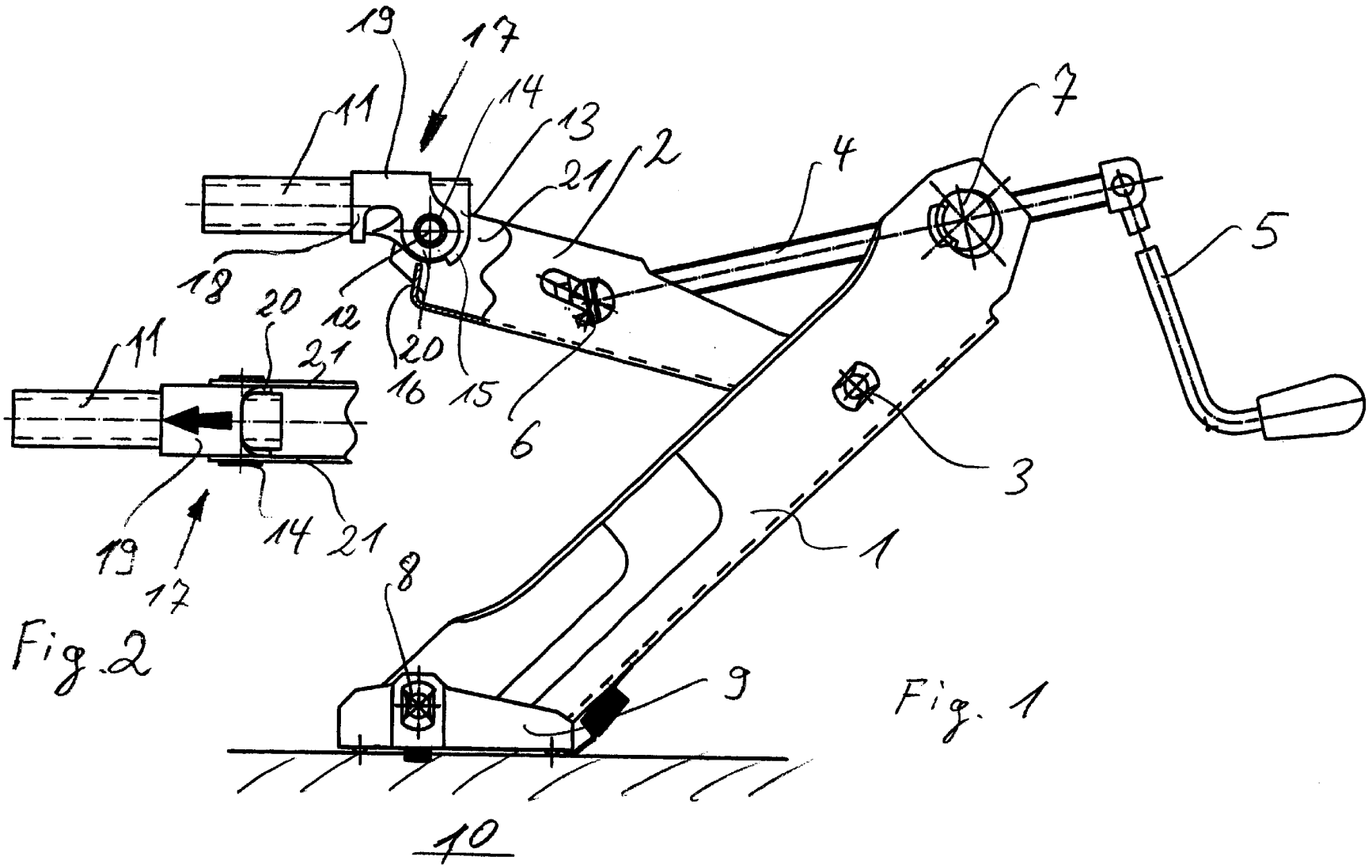
FIG. 1 shows a view of an articulated jack and FIG. 2 shows a plan view of the insertion trunnion disposed at the front end of this articulated jack.

Jacks of different construction are used to lift motor vehicles, particularly when changing wheels. In the example, an articulated jack is described and shown in FIG. 1. However, the object of the invention can be used in the same way for other types of jacks.

The articulated jack, shown in FIG. 1, has a standing leg 1 and a supporting arm 2, which are pivotably connected to one another by means of a joint 3. A threaded spindle 4, at the end of which a hand crank 5 is disposed, connects the standing leg 1 and the supporting arm 2 over further joints 6, 7. The joint 6, disposed at the supporting arm 2, is connected with a journal bearing. The joint 7, disposed at the upper end of the standing leg at 1, includes a moving nut, which accommodates the threaded spindle 4. Due to the measures described, the supporting arm 2 is swiveled up or down with respect to the standing leg 1 by rotating the threaded spindle 4.

A foot 9, which can rotate and rests on the ground, is mounted over a further joint 8 at the lower end of the standing leg 1. As a result of the movement between the supporting arm 2 and the standing leg 1, initiated by means of the hand crank 5 and the threaded spindle 4, the front end of the supporting arm 2 is raised or lowered relative to the ground 10. A supporting element, which is disposed at this front end of the supporting arm 2 and connected in a specified manner with the vehicle that is to be lifted or which supports this vehicle in a suitable manner, then causes the vehicle to be raised or lowered with respect to the ground 10.

In the case of the generic jack, an insertion trunnion 11, which can be folded vertically, is disposed as supporting element at the front end of the supporting arm 2. This insertion trunnion 11 is pushed into a corresponding opening of the vehicle, which is not shown. By these means, it is achieved that the jack is connected positively with the vehicle in the lifting direction. The ability to hold the insertion trunnion 11 vertically is brought about by a further joint 12 hold, which is disposed horizontally and constructed as a hollow axis. In the front section, the insertion trunnion 11 is constructed as a hollow trunnion and is produced by rolling a metal sheet. In the rear region, this metal sheet is not rolled together into a hollow mandril and, instead, forms a fastening tab 13. The hollow rivet to 14, forming the joint 12, is passed through boreholes, disposed in these fastening tabs 13. Stops 15 at the fastening tabs 13, together with a transverse wall 16 mounted at the front end of the supporting arm 2, ensure that the upward swiveling motion of the insertion trunnion 11 is limited.

To limit the depth of insertion of the insertion trunnion 11 in the accommodating borehole at the vehicle and to prevent damaging the body of the vehicle by pushing the jack to close to parts of the body, a stop 17 is provided at the insertion trunnion 11. In its front region, this stop 17 is constructed as a ring-shaped sleeve 18, embracing the insertion trunnion 11, and, over a back Part 19, changes into two laterally disposed tabs 20. These tabs 20, like the fastening tabs 13 of the insertion trunnion 11, are provided with boreholes, through which the hollow rivet 14 of the joint 12 extends. Accordingly, the tabs 20 lie between the fastening tabs 13 of the insertion trunnion 11 and the side walls 21 of the supporting arm 2. After the hollow rivet 14 is flanged laterally at the outside of the side walls 21 of the supporting arm 2, the joint 12 is finished.

As shown in FIG. 2, an inscription or marking can be applied to the back part 19 of the stop 17. In FIG. 2, an instruction arrow is affixed on this back part 19, which is to give the instruction that the insertion trunnion 11 is to be pushed completely, up to the stop 17, into the accommodating opening of the vehicle, which is to be lifted.

In the example, the stop 17, consisting of sleeve 18, back part 19 and tab 20, is produced in one part from a suitable plastic.

LIST OF REFERENCE SYMBOLS

1. Standing leg
2. Supporting arm

3. Joint
4. Threaded spindle
5. Hand crank
6. Joint
7. Joint
8. Joint
9. Foot
10. Ground
11. Insertion trunnion
12. Joint
13. Fastening tab
14. Hollow rivet
15. Stop
16. Transverse wall
17. Stop
18. Sleeve
19. Back part
20. Tab
21. Side wall

What is claimed is:

1. A jack comprising: a supporting element; an insertion trunnion foldable vertically over a joint; a stop limiting the depth of insertion of said insertion trunnion; said stop being constructed as a part of an intermediate layer between said insertion trunnion and said supporting element disposed in the region of the joint for reducing wear between said trunnion and said supporting element; said intermediate layer being disposed on either side between said insertion trunnion and said supporting element; said stop being constructed as a ring-shaped sleeve embracing said insertion trunnion; said stop and said intermediate layer comprising plastics; said supporting element being on a supporting arm and being an articulated jack.

2. A jack comprising: a supporting element; an insertion trunnion foldable vertically over a joint; a stop limiting the depth of insertion of said insertion trunnion; said stop being constructed as a part of an intermediate layer between said insertion trunnion and said supporting element disposed in the region of the joint for reducing wear between said trunnion and said supporting element; said stop being constructed as a ring-shaped sleeve embracing said insertion trunnion.

3. A jack comprising: a supporting element; an insertion trunnion foldable vertically over a joint; a stop limiting the depth of insertion of said insertion trunnion; said stop being constructed as a part of an intermediate layer between said insertion trunnion and said supporting element disposed in the region of the joint for reducing wear between said trunnion and said supporting element; said stop being constructed as a ring-shaped sleeve embracing said insertion trunnion.

* * * * *